US007160674B2

(12) United States Patent
Wichmann

(10) Patent No.: US 7,160,674 B2
(45) Date of Patent: Jan. 9, 2007

(54) PHOTOGRAPHIC CHEMICALS BUNDLE

(75) Inventor: Ralf Wichmann, Gladbach (DE)

(73) Assignee: A&O Imagining Solutions GmbH (DE)

( * ) Notice: Subject to any disclaimer, the term of this patent is extended or adjusted under 35 U.S.C. 154(b) by 0 days.

(21) Appl. No.: 10/902,708

(22) Filed: Jul. 29, 2004

(65) Prior Publication Data

US 2005/0048420 A1 Mar. 3, 2005

(30) Foreign Application Priority Data

Aug. 29, 2003 (DE) ..... 103 39 828
Dec. 19, 2003 (DE) ..... 103 59 626

(51) Int. Cl.
*G03C 7/44* (2006.01)

(52) U.S. Cl. ..... 430/398; 430/399; 430/400; 430/449; 430/460; 430/466; 430/493; 206/229; 206/526; 220/23.88

(58) Field of Classification Search ..... 430/398, 430/399, 400, 449, 460, 466, 493; 206/229, 206/526; 220/23.88
See application file for complete search history.

(56) References Cited

U.S. PATENT DOCUMENTS

| | | | | |
|---|---|---|---|---|
| 5,384,233 | A | 1/1995 | Kuse et al. | |
| 5,595,860 | A * | 1/1997 | Ishikawa et al. | 430/372 |
| 5,660,100 | A | 8/1997 | Spelten et al. | |
| 5,670,305 | A | 9/1997 | Gordon et al. | |
| 5,891,608 | A | 4/1999 | Hashimoto et al. | |
| 6,077,651 | A | 6/2000 | Darmon et al. | |
| 6,413,703 | B1 | 7/2002 | Tappe et al. | |
| 6,457,602 | B1 | 10/2002 | Uchiyama | |
| 6,468,722 | B1 * | 10/2002 | Call et al. | 430/461 |
| 6,468,723 | B1 * | 10/2002 | Tappe et al. | 430/466 |
| 6,726,382 | B1 | 4/2004 | Buttner et al. | |
| 2002/0117416 | A1 | 8/2002 | Danner et al. | |
| 2002/0164167 | A1 * | 11/2002 | Abe | 396/564 |

FOREIGN PATENT DOCUMENTS

| | | | |
|---|---|---|---|
| DE | 196 26 699 | A1 | 1/1998 |
| DE | 199 26 176 | A1 | 12/2000 |
| DE | 100 05 498 | | 4/2001 |
| DE | 101 62 748 | | 7/2003 |
| EP | 0 329 088 | | 8/1989 |
| EP | 0 507 126 | | 10/1992 |
| EP | 0 532 003 | | 3/1993 |
| EP | 0 556 782 | | 8/1993 |
| EP | 0 567 126 | | 10/1993 |
| EP | 0 569 852 | | 11/1993 |
| EP | 0 574 829 | A1 | 12/1993 |
| EP | 0 584 665 | | 3/1994 |
| EP | 0 588 289 | | 3/1994 |
| EP | 0 599 620 | | 6/1994 |
| EP | 0 657 777 | | 6/1995 |
| EP | 0 723 194 | | 7/1996 |
| EP | 0 726 203 | | 8/1996 |
| EP | 0 750 226 | | 12/1996 |
| EP | 0 800 111 | A1 | 10/1997 |
| EP | 0 840 166 | | 5/1998 |
| EP | 0 851 287 | | 7/1998 |
| EP | 0 871 065 | | 10/1998 |
| EP | 0 947 429 | A1 | 10/1999 |
| EP | 1 085 375 | A1 | 3/2001 |

* cited by examiner

*Primary Examiner*—Hoa Van Le
(74) *Attorney, Agent, or Firm*—Connolly Bove Lodge & Hutz

(57) ABSTRACT

A bundle for simultaneous refilling of chemicals for processing color photography silver halide materials in an automatic processing apparatus, wherein the bundle comprises at least one bottle with the refilling solution for a color developer and at least two bottles with refilling solutions for a bleach-fixing bath, characterized in that the bottle with the refilling solution for the color developer comprises more than 60 g of color developer substance per 1 L of bottle volume, is distinguished in that the capacity of the bundle is increased.

18 Claims, No Drawings

PHOTOGRAPHIC CHEMICALS BUNDLE

The invention relates to a bundle for simultaneous refilling of chemicals for processing colour photography silver halide materials (photographic materials) in an automatic processing apparatus, wherein the bundle comprises at least one bottle with the refilling solution for a colour developer and at least two bottles with refilling solutions for a bleach-fixing bath.

Three different concentrates are conventionally used for preparation of colour developer solutions, since certain constituents of the developer bath are not compatible with one another during a relatively long storage time. Thus e.g. one concentrate comprises the antioxidant, an auxiliary solvent and a whitener, a second concentrate comprises the colour developer substance, e.g. 4-(N-ethyl-N-2-methylsulfonylaminoethyl)-2-methyl-phenylenediamine sesquisulfate (CD-3) or 4-(N-ethyl-N-2-hydroxyethyl)-2-methylphenylenediamine sulfate (CD-4) and a third concentrate comprises a buffer substance, alkali and an sequestering agent.

In recent years single-part one- or multiphase developer concentrates have also increasingly become available. These have the advantage that they simplify preparation of the working solution and errors can be avoided during preparation or refilling of a developer solution.

In modern minilabs in which image data can be processed digitally, bundles, usually cardboard cartons, are also increasingly being employed as refilling systems for several chemical concentrates. The concentrate bottles used therein are made of plastic and contain the chemicals as solids in the form of tablets or granules or as highly concentrated liquid solutions. In most apparatus designs the concentrate bottles are stored standing on their head in a common carton in the machine, the pouring openings being at the same height viewed from the base of the carton. When required, the seal with which the bottles standing on their head are closed is pierced with a mandrel by the machine and the concentrates flow via a hose of plastic in each case into a suitable replenisher reservoir tank (replenisher tank) in the machine. All the bottles of a bundle are always opened at the same time, so that the individual chemical solutions must be such that they are consumed at the same time. After the concentrates have flowed out, the cartons with the emptied bottles are removed from the apparatus and then disposed of.

Conventional processing apparatuses for photographic materials have replenisher tanks from which the processing solutions in the processing tanks are replenished by metering in the replenisher solutions present therein as a function of the amount of material processed. In order to be able to process customers' orders as quickly as possible, small processing apparatuses for photographic materials, so-called minilabs, are nowadays often installed directly in shops. Since the replenisher tanks of minilab apparatuses have a certain predetermined volume (replenisher volume) in the apparatus because of the construction, only a certain amount of photographic material can be processed with a predetermined replenishment rate. Thus e.g. a commercially available minilab apparatus has a predetermined replenisher volume for the colour developer of 4.5 litres, which is obtained in that the closure (seal) of a bottle with the colour developer concentrate from the bundle is pierced and the concentrate flows into the replenisher reservoir tank and is automatically refilled with water up to the replenisher volume of 4.5 litres. If the replenishment rate is e.g. 60 ml/m$^2$ of material, a maximum of 75 m$^2$ of paper can be processed before the replenisher volume is consumed and a new bundle has to be docked on to the apparatus. A higher capacity, i.e. a larger amount of processed material, is therefore not possible.

However, an increased capacity can be achieved if the replenishment rate is reduced. At a predetermined replenisher volume of 4.5 L, for an increase in the capacity of a bundle to 100 m$^2$ the colour developer replenishment rate would theoretically have to be reduced to 45 ml/m$^2$. At such a low replenishment rate, however, there is the risk that because of carry over of liquid out of the colour developer tank by the material and the additional evaporation in the processing tank, the level of liquid in the colour developer tank drops constantly and as a result the tank runs dry or falls below its minimum level.

Furthermore, when calculating the dimensions of refilling bundles, the limiting condition that the replenishment rates conventionally are not identical for the processing baths, and in particular that the replenishment rates as a rule cannot be adjusted independently of one another must be taken into account. Thus, for example, a commercially available processing apparatus for photographic paper has a 4.5 L replenisher tank for the colour developer solution, a 7.5 L replenisher tank for the bleach-fixing solution and a 4.5 L replenisher tank for the stabilizer solution. So that the tanks can always be refilled at the same time, the ratio of the replenishment rates of colour developer solution, bleach-fixing solution and stabilizer solution is determined by the apparatus at 1:1⅔:1. If, for example, a replenishment rate for the colour developer of 60 ml/m$^2$ is set manually, a replenishment rate for the bleach-fixing solution of 100 ml/m$^2$ and a replenishment rate for the stabilizer solution also of 60 ml/m$^2$ results from this. The amounts of chemicals in a refilling bundle must therefore accurately render possible the matching concentrations in the replenisher tanks which are necessary for the coupled replenishment rates.

The known, conventionally parallelepipedal bundles (cartons) often have a small depth (shortest side of the base area). Although the reasons for these dimensions are not known in detail, it can be assumed that the inexpensive availability of standard bottles and filling machines and the easier handling (easier holding) are responsible for this. However, such cartons are very unstable when stored standing and easily tip over both when filled and when emptied. Considerable damage can result from a filled carton weighing several kilograms tipping over, and in the worst case chemicals can even run out. Since the emptied carton does not run completely empty, residues of chemicals can likewise run out after tipping over. To compensate this disadvantage in part, the tall standard bottles used in such bundles are often filled up only incompletely, in order to displace downwards the centre of gravity of the cartons used to thereby achieve an improved mechanical stability during standing storage. Incomplete filling often also results due to the different maximum possible concentrations of chemicals in the individual bottles and the limiting conditions mentioned with respect to the replenishment rates.

However, this results in considerable disadvantages, such as e.g. an increased oxidation of the concentrate by air and a reduced capacity of the replenisher prepared from the concentrate. The refilling bundles used hitherto moreover have the disadvantage that at a low replenishment rate of the colour developer or during relatively long storage times of the colour developer replenisher they lead to a significant increase in the fog of the photographic material processed. In the extreme case tarring may occur in the replenisher tanks.

An even greater reduction in the capacity results from the use of smaller (less tall) standard bottles, since these are usually only available in crude volume steps, such as e.g. 0.5, 1.0 and 2.0 litres. Where bottle volumes are referred to in the following, these are in each case the standard size of the bottle, which has a certain tolerance. A 1 litre bottle has e.g. a fill volume of about 1 litre, varies according to the manufacturer and conventionally has a tolerance of +/−50 ml from bottle to bottle and from production batch to production batch.

It has furthermore proved to be a disadvantage if bottles of different height are used in a bundle. Since the bottle openings of the bundle must be arranged at the same height, a hollow space remains behind the shorter bottles, into which the bottles can be pushed during opening (piercing of the seal) and then are not emptied. Because of the high pressure which acts on the bottle during opening, it has also proved to involve too much outlay to secure the bottles e.g. by additional inserts in the carton.

The known refilling bundles also have an inadequate capacity, as a result of which such bundles have to be changed frequently. This is considerably time-consuming for the operating staff and shortens the time during which the apparatus can be operated unattended.

The invention is thus based on the object of providing a bundle for refilling processing chemicals which renders possible an increased capacity, that is to say has to be changed only rarely, which is stable and easy to handle, can easily be emptied (pierced), ensures a good stability of the chemical concentrates contained therein and of the replenisher solution prepared therefrom, and which, in the processing of photographic material, renders possible a good image quality, in particular low minimum densities and high maximum densities.

It has now been found, surprisingly, that this is achieved with a refilling bundle for photographic chemicals which comprises at least one bottle for a colour developer and at least two bottles for a bleach-fixing bath, wherein the refilling bottle for the colour developer contains more than 60 g, preferably at least 65 g, more preferably at least 70 g and particularly preferably at least 75 g of colour developer substance per 1 L of bottle volume.

The invention therefore provides a bundle for simultaneous refilling of chemicals for processing colour photography silver halide materials in a automatic processing apparatus, wherein the bundle comprises at least one bottle with the refilling solution for a colour developer and at least two bottles with refilling solutions for a bleach-fixing bath, characterized in that the bottle with the refilling solution for the colour developer contains more than 60 g of colour developer substance per 1 L of bottle volume.

The refilling systems employed comprise colour developer concentrates in which the colour developer substance is contained at least in a concentration of 0.11 mol/L. The concentration of the colour developer substance is preferably at least 0.13 mol/L, and particularly preferably at least 0.15 mol/L.

In the ready-prepared replenisher solutions, the concentration of the colour developer solution is at least 0.03 mol/L and particularly preferably at least 0.04 mol/L.

The colour photography silver halide materials for the processing of which the chemicals in the bundle according to the invention are envisaged can be any desired materials comprising colour couplers, but are preferably colour paper, in particular that with chloride-rich silver halide emulsions which is suitable for the AP 94 process.

In addition to the refilling bottle for the developer and the two refilling bottles for the bleach-fixing bath, the bundle according to the invention can also comprise further refilling bottles. Preferably, the bundle also comprises a refilling bottle for the stabilizer bath.

In a preferred embodiment of the invention, the bundle comprises refilling solutions for processing colour paper, in particular AgCl-rich colour paper, and the refilling solutions are, in particular, those for an AP 94- or RA 4-compatible process.

The known colour developer compositions can be used for the colour developer refilling solution as long as they allow a concentration of at least 60 g of colour developer per 1 L of bottle volume. The colour developer substance is chosen in a known manner as a function of the material to be processed.

In a particularly preferred embodiment, the colour developer substance is 4-(N-ethyl-N-2-methylsulfonylaminoethyl)-2-methylphenylenediamine sesquisulfate (CD-3).

In a particularly preferred embodiment of the invention, the refilling bundle comprises exactly one bottle with the refilling solution for a colour developer, exactly two bottles with refilling solutions for a bleach-fixing bath and exactly one bottle with the refilling solution for a stabilizer bath and is used for processing of colour photographic paper.

In this case the colour developer refilling solution must be a single-part colour developer concentrate, which can be either one-phase or multiphase.

The refilling solution according to the invention for a colour developer substance (developer concentrate) also comprises, in addition to the colour developer substance, the conventional chemicals required for development of a colour photography material, in particular an antioxidant, a wetting agent, an sequestering agent, a whitener, a complexing agent, a buffer system and alkali. In a particularly preferred embodiment of the invention, the concentrate comprises an antifoam. The desired final volume is established by addition of water, for which demineralized water is preferably used.

In a preferred embodiment of the invention, the colour developer concentrate is a multiphase, in particular two-phase concentrate, which is prepared as described in DE 100 05 498 and to which a wetting agent can preferably be added at any desired point in time in the preparation.

The concentrate preferably comprises no undissolved constituents and is precipitate-free in particular during storage for at least 1 month, particularly preferably also during storage below 0° C., in particular between 0° C. and −7° C.

In a preferred embodiment, the concentrate moreover comprises a minimum amount of one or more water-soluble organic solvents.

In a preferred embodiment, the organic solvent comprises a mixture of polyethylene glycols of different molecular weight, from monoethylene glycol to polyethylene glycol with an average molecular weight of 20,000, for example a mixture of diethylene glycol, polyethylene glycol with the average molecular weight of 400 and polyethylene glycol with the average molecular weight of 1,500. The average molecular weights are weight-average.

Optimum adjustments for precipitate-free single-part, optionally even one-phase developer concentrates can be established in this manner.

The polyethylene glycol mixture makes up, in particular, at least 90 vol. % of the organic solvent.

Possible water-soluble organic solvents are those from the series consisting of glycols, polyglycols, alkanolamines, aliphatic and heterocyclic carboxamides and aliphatic and cyclic monoalcohols, the weight ratio of water to organic solvent in the refilling solution preferably being 50:50 to 95:5, more preferably 60:40 to 90:10 and particularly preferably 65:35 to 85:15.

Suitable water-soluble solvents are e.g. carboxylic acid amide and urea derivatives, such as dimethylformamide, methylacetamide, dimethylacetamide, N,N'-dimethylurea, tetramethylurea, methanesulfonamide, dimethylethyleneurea, N-acetylglycine, N-valeramide, isovaleramide, N-butyramide, N,N-dimethylbutyramide, N-(2-hydroxyphenyl)-acetamide, N-(2-methoxyphenyl)-acetamide, 2-pyrrolidinone, ϵ-caprolactam, acetanilide, benzamide, toluenesulfonamide and phthalimide;

aliphatic and cyclic alcohols, e.g. isopropanol, tert-butyl alcohol, cyclohexanol, cyclohexanemethanol and 1,4-cyclohexanedimethanol;

aliphatic and cyclic polyalcohols, e.g. glycols, polyglycols, polywaxes, trimethyl-1,6-hexanediol, glycerol, 1,1,1-trimethylolpropane, pentaerythritol and sorbitol;

aliphatic and cyclic ketones, e.g. acetone, ethyl methyl ketone, diethyl ketone, tert-butyl methyl ketone, diisobutyl ketone, acetylacetone, acetonylacetone, cyclopentanone and acetophenol;

aliphatic and cyclic carboxylic acid esters, e.g. triethoxymethane, methyl acetate, allyl acetate, methyl glycol acetate, ethylene glycol diacetate, glycerol 1-acetate, glycerol diacetate, methylcyclohexyl acetate, salicylic acid methyl ester and salicylic acid phenyl ester;

aliphatic and cyclic phosphonic acid esters, e.g. methylphosphonic acid dimethyl ester and allylphosponic acid diethyl ester;

aliphatic and cyclic oxy-alcohols, e.g. 4-hydroxy-4-methyl-2-pentanone and salicylaldehyde;

aliphatic and cyclic aldehydes, e.g. acetalehyde, propanal, trimethylacetaldehyde, crotonaldehyde, glutaraldehyde, 1,2,5,6-tetrahydrobenzaldehyde, benzaldehyde, benzenepropane and terephthalaldehyde;

aliphatic and cyclic oximes, e.g. butanone oxime and cyclohexanone oxime;

aliphatic and cyclic amines (primary, secondary or tertiary), e.g. ethylamine, diethylamine, triethylamine, dipropylamine, pyrrolidine, morpholine and 2-aminopyrimidine;

aliphatic and cyclic polyamines (primary, secondary or tertiary), e.g. ethylenediamine, 1-amino-2-diethylaminoethane, methyl-bis-(2-methylamino-ethyl)amine, permethyl-diethylenetriamine, 1,4-cyclohexanediamine and 1,4-benzenediamine;

aliphatic and cyclic hydroxyamines, e.g. ethanolamine, 2-methylethylamine, 2-methylaminoethanol, 2-(dimethylamino)ethanol, 2-(2-dimethylamino-ethoxy)-ethanol, diethanolamine, N-methyldiethanolamine, triethanolamine, 2-(2-aminoethylamino)-ethanol, triisopropanolamine, 2-amino-2-hydroxymethyl-1,3-propanediol, 1-piperidine-ethanol, 2-aminophenol, barbituric acid, 2-(4-aminophenoxy)-ethanol and 5-amino-1-naphthol.

Multiphase means that the concentrate comprises two or more liquid phases, but no precipitate. The liquid phases are e.g. an aqueous and an organic phase.

The molar ratio of antioxidant to developer substance in the refilling solution is preferably 0.5:1 to 4:1, more preferably 0.6:1 to 3.5:1 and particularly preferably 0.7:1 to 3.0:1.

Suitable antioxidants are compounds of the formula (I), (II) and (III).

(I)

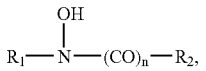

wherein $R_1$ denotes optionally substituted alkyl, $R_2$ denotes optionally substituted alkyl or optionally substituted aryl and n denotes 0 or 1, preferably those in which at least one of the radicals $R_1$ and $R_2$ contains at least one —OH, —COOH or —$SO_3H$ group;

(II)

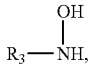

wherein $R_3$ denotes an alkyl or acyl group;

(III)

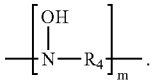

wherein $R_4$ denotes an alkylene group which is optionally interrupted by O atoms and m denotes a number from at least 2.

The alkyl groups $R_1$, $R_2$ and $R_3$, the alkylene group $R_4$ and the aryl group $R_2$ can contain further substituents beyond the substitution mentioned.

Examples of suitable antioxidants are (0-1)

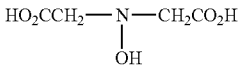

(0-2)

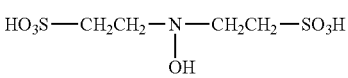

(0-3)

$CH_3CH(CH_3)NHOH$ (0-4)

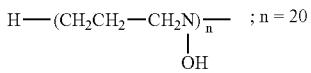

(0-5)

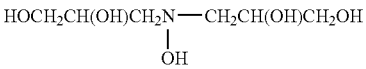

(0-6)

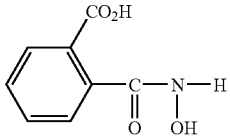

(0-7)

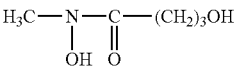

-continued

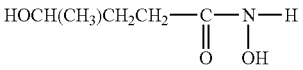

(0-8)

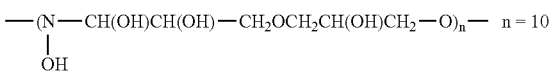

(0-9)

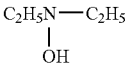

(0-10)

A particularly preferred antioxidant is (0–2).

On dilution of the concentrate with water for the preparation of the ready-to-use colour developer or the replenisher, any phase boundaries present disappear; the ready-to-use developer is one-phase.

In a further advantageous embodiment of the invention, the concentrate is a homogenous one-phase concentrate which is prepared in particular as described in U.S. Pat. No. 6,077,651, and to which a wetting agent is preferably added at any desired point in time during the preparation.

These one-phase concentrates have a pH of about 7 to about 13 and comprise a comparatively high content of water-miscible, in particular straight-chain, organic solvents which carry hydroxyl groups and have a molecular weight of about 50 to 200, and a buffer substance which is soluble therein. The weight ratio of water to the organic solvent is preferably between 15:85 and 50:50.

The buffer substance preferably has a pKa of between 9 and 13. Suitable buffer substances are e.g. carbonates, borates, tetraborates, salts of glycine, triethanolamine, diethanolamine, phosphates and hydroxybenzoates, of which alkali metal carbonates, such as e.g. sodium carbonate and potassium carbonate, are preferred.

In the preparation of the single-part one-phase concentrate, an alkali metal base is added to an aqueous solution which comprises the sulfate of the colour developer and optionally further additives, and alkali metal sulfate is then precipitated out by addition of the organic solvent. The alkali metal sulfate is separated off by any desired suitable separation technique, e.g. by filtering.

Organic solvents which are particularly suitable for this are e.g. polyols, and of these in particular glycols, such as ethylene glycol, diethylene glycol and triethylene glycol, polyhydroxyamines, and of these in particular polyalkanolamines, and alcohols, in particular ethanol and benzyl alcohols. The organic solvent which is most suitable for the preparation of one-phase single-part concentrates is diethylene glycol.

The refilling solution for a bleach-fixing bath can be a single-part bleach-fixing bath concentrate which is divided between the two bottles, but it is preferably a two-part bleach-fixing bath concentrate with the parts (BX-1) and (BX-2), wherein (BX-1) substantially comprises a thiosulfate salt and a stabilizer for this, in particular a sulfite salt, and (BX-2) substantially comprises an Fe(III) complexing agent, as a result of which decomposition reactions can largely be avoided. The pH of (BX-1) is preferably 5 to 7 and that of (BX-2) is preferably 2 to 7, in particular 3 to 7.

The known bleach-fixing bath concentrates can be used for the invention.

Bleach-fixing baths (BX baths) are employed in the colour photography processing process in order to oxidize the metallic silver formed by the development into a soluble form (bleaching) and to dissolve it out of the material in this form together with non-developed silver halide by complexing (fixing). BX baths such as are described e.g. in EP 569 852 A1, and therefore also the bleach-fixing bath concentrates, comprise a number of necessary chemicals for this task, namely an iron(III) complex salt as an oxidizing agent, a thiosulfate as a fixing agent and a sulfite, disulfite or a sulfinic acid as a stabilizer for the thiosulfate.

Fe(III) complex salts which are suitable for photographic bleach and bleach-fixing baths are known from a large number of documents (e.g. EP 329 088, 584 665, 556 782, 532 003, 750 226, 657 777, 599 620, 588 289, 723 194, 851 287, 840 168, 871 065, 567 126, and U.S. Pat. No. 5,670,305).

The complexing agents are also suitable for the Fe(II) complex salts.

Preferred complexing agents for Fe(III) are: ethylenediaminetetraacetic acid (EDTA), β-alaninediacetic acid (ADA), diethylenetriaminepentaacetic acid (DTPA), methyliminodiacetic acid (MIDA), ethylenediaminemonosuccinate (EDMS), methylgycinediacetic acid (MGDA), ethylenediaminedisuccinate (EDDS), specifically (S,S)-EDDS, iminosuccinic acid, iminosuccinic acid-propionic acid and 2-hydroxypropyliminodiacetic acid.

Mixtures of these complexing agents can also be employed, and between 0.1 to 1 mol/L of Fe(III) complexing agents are preferably employed.

In addition, other complexing agents can also be added individually or in a mixture:

polycarboxylic acids: e.g. oxalic acid, malonic acid, glutaric acid, adipic acid, suberic acid, fumaric acid, maleic acid and itaconic acid;

(poly)hydroxypolycarboxylic acids: e.g. citric acid, glycollic acid, lactic acid, malic acid, tartaric acid and galactaric acid.

Of these additional complexing agents, preferably 1 to 200 mmol, in particular 5 to 50 mmol/l of concentrate are employed.

Suitable sulfites are e.g. ammonium sulfite, ammonium hydrogen sulfite, sodium sulfite, sodium disulfite, sodium hydrogen sulfite, potassium sulfite, potassium disulfite and potassium hydrogen sulfite. Suitable sulfinic acids are e.g. hydroxymethanesulfinic acid, formamidinesulfinic acid, benzenesulfinic acid, p-toluenesulfinic acid, methanesulfinic acid and o-amidosulfinic acid.

The bleach-fixing bath concentrate according to the invention can comprise a phosphate, polyphosphate, polyphosphonate, nitrate or bromide. Phosphates which can be employed are the alkali metal salts and/or ammonium salts, e.g. ammonium dihydrogen phosphate, di-ammonium hydrogen phosphate, tri-ammoniumn phosphate, potassium dihydrogen phosphate, di-potassium hydrogen phosphate, tri-potassium phosphate, sodium dihydrogen phosphate, di-sodium hydrogen phosphate, tri-sodium phosphate or the free phosphoric acid.

Polyphosphates and -phosphonates which can be employed are e.g. sodium hexametaphosphate, sodium tetraphosphate, hydroxyethanediphosphonic acid, N-(2-carboxyethyl)-1-aminoethane-1,1-diphosphonic acid, N,N-bis-(carboxymethylene)-1-aminoethane-l,l-diphosphonic acid, morpholinomethanediphosphonic acid, nitrilotrismethylenephosphonic acid, ethylenediaminetetramethylenephosphonic acid, hexamethylenediaminetetramethylenephosphonic acid, 2-phosponobutane-1,2,4-tricarboxylic acid and 2-carboxyethanephosphonic acid. Free polyphosphoric acids are also suitable.

Alkali metal and/or ammonium nitrates and bromides can be employed as nitrates and bromides.

The phosphates, polyphosphates and polyphosphonate, nitrates and bromides are preferably added to the concentrate in an amount of 0.01 to 2.5 mol/L, in particular 0.05 to 1 mol/L.

Suitable fixing agents are, in particular, sodium thiosulfate, potassium thiosulfate and ammonium thiosulfate.

Further constituents can be e.g. aminopolycarboxylic acid, rehalogenating agents, e.g. ammonium bromide, acids and alkalis for pH adjustment, bleaching accelerators, white couplers and buffer substances (see Research Disclosure 37 038, February 1995, pages 107 to 109).

Preferred buffer substances are dicarboxylic acids, e.g. malonic acid, succinic acid and adipic acid.

The pH is, in particular, 4 to 9.

An example of refilling solutions (BX-1) and (BX-2) for a bleach-fixing bath which is particularly suitable in the context of the present invention is given in the following:

(BX-1):
For 1 litre of concentrate dissolve
500 g ammonium thiosulfate and
120 g sodium disulfite
in water, make up to 1 litre with water and adjust the pH to 5.5 with ammonia or acetic acid.

(BX-2):
For 1 litre of concentrate dissolve
500 g ammonium iron(III) ethylenediaminetetraacetate (EDTA)
in water, make up to 1 litre with water and adjust the pH to 6.8 with acetic acid.

The conventional compositions can be used according to the invention as refilling solutions for a stabilizer bath, e.g. the stabilizer solution 94 SB-R.

An example of a refilling solution (SB) which is particularly suitable for a stabilizer bath in the context of the present invention is given in the following.

(SB):
For 1 litre of concentrate dissolve
80 g sodium sulfite,
60 g ethylenediaminetetraacetic acid (EDTA acid)
50 g 1-hydroxyethane-1,1-diphosphonic acid (HEDP acid),
80 g potassium hydroxide and
5 g Proxel GXL
in water, make up to 1 litre with water and adjust the pH to 8 with potassium hydroxide solution.

To achieve the object according to the invention, it has proved preferable if the bottles in the refilling bundle are rectangular and have a ratio of height (H) of the bottles to the widest base side (S) of 1.5 to 3, the height being measured from the bottle base to below the bottle neck. This has proved to be a particularly good compromise between stability and easy handling.

It is furthermore particularly advantageous if the bottles, in particular those with the colour developer, are filled as high as possible, in particular if they are each filled to at least 90 vol. % and more preferably to at least 95 vol. %.

To take into account the diverse limiting conditions described above with respect to the individual replenishment rates and the concentrations which can be established in the refilling solutions, it has proved advantageous if the bottle size for the colour developer refilling solution is about 1 L. It is furthermore preferable if the bottle size for one of the at least two refilling solutions for the bleach-fixing bath is about 2 L, and for the other of the at least two refilling solutions for the bleach-fixing bath is about 1 L.

In a particularly preferred embodiment of the invention, the refilling bundle comprises a 1 L bottle with a refilling solution for a colour developer (colour developer bath), a 2 L bottle with the (BX-1) part of a refilling solution for a bleach-fixing bath, a 1 L bottles with the (BX-2) part of a refilling solution for a bleach-fixing bath and a 1 L bottle with a refilling solution for a stabilizer bath.

The invention also provides a process for processing a colour photography silver halide material using an automatic processing apparatus, wherein the silver halide material runs through a colour developer solution, a bleach-fixing solution and stabilizer solution, the colour developer solution is replenished by metering in from at least one colour developer replenisher tank and the bleach-fixing solution is replenished by metering in from at least one bleach-fixing replenisher tank and the replenisher tanks are refilled via a chemicals bundle, characterized in that the chemicals bundle is a bundle according to the invention.

The processing conditions, suitable colour developer substances, suitable buffer substances, suitable sequestering agents, suitable whiteners, auxiliary developers, development accelerators and antifogging agents are described in Research Disclosure 37 038 (February 1995) on pages 102 to 107.

In order to achieve an increased capacity (processed material per refilling bundle), replenishment rates which are as low as possible are established during the processing. Preferably, the colour developer solution is replenished with less than 60 ml of colour developer replenisher solution per $m^2$ of process material (replenishment rate less than 60 0ml/$m^2$), and the replenishment rate is particularly preferably less than 55 ml/$m^2$.

The bundle is preferably designed such that at least 80 $m^2$ of material, preferably at least 90 $m^2$ of material, can be processed with the contents of one refilling bundle.

The bleach-fixing solution is also replenished according to the invention with the lowest possible replenishment rates, but the coupling of the replenishment rates which is described above has to be regarded here. Preferably, the replenishment rate of the bleach-fixing solution is less than 100 ml/$m^2$, more preferably less than 90 ml/$m^2$ and particularly preferably less than 80 ml/$m^2$.

To prevent the disadvantages of low replenishment rates described in the introduction, such as e.g. a tank running empty, in a particularly preferred embodiment of the invention, in addition to the colour developer replenisher a defined amount of water per $m^2$ of processed photographic material is also additionally metered into the colour developer tank. As a result e.g. a replenishment rate of 45 ml/$m^2$ from the replenisher tank can be increased to a metering-in of in total 45 ml/$m^2$+x ml/$m^2$ of extra water and the capacity of a bundle can thereby remain unchanged at 100 $m^2$. The additional metering of water takes place here e.g. from a water reservoir tank present in the apparatus, via separate pumps. This procedure ensures that the colour developer tank does not run dry even at high evaporation and nevertheless an increased capacity can be achieved by a reduced colour developer replenishment rate. x is e.g. from 0 to 50 for the colour developer replenishment and e.g. 0 to 400 for the stabilizer bath replenishment. Preferably, x is chosen such that during the colour developer replenishment 5 to 50% of extra water, in particular 10 to 25%, in each case based on the metering of the colour developer replenisher solution, is additionally metered in. For the stabilizer bath replenishment x is preferably chosen such that 50 to 400% of extra water, in particular 100 to 300%, in each case based on the metering of the stabilizer bath replenisher solution, is metered in here.

The same principle can preferably also be employed for the remaining processing solutions.

In order to obtain smaller amounts of residual solutions, it has proved favourable, after the refilling solutions have run in, for the colour developer replenisher tank to be filled up with water and the bleach-fixing replenisher tank at least partly with the overflow of the stabilizer solution.

The invention is particularly suitable for high-speed processing processes in which the development time is preferably less than 45 s, more preferably less than 40 s and particularly preferably less than 35 s.

The invention also provides the use of a bundle for refilling the replenisher tanks of an automatic processing apparatus for colour photography silver halide materials, characterized in that it is a bundle according to claim 1, it being preferable if the bottles in the bundle have round screw closures and a seal, the bottles are held together by a carton from which the screw closures project at the same height and, after insertion into the apparatus, are held standing on their head at the wide edge of the screw closures or at the carton surface between the screw closures.

To render possible reliable insertion of the bundles according to the invention into a processing apparatus, the bundles are preferably equipped with features by which the bundles are positioned in the apparatus or by which mixing up is ruled out. For reliable positioning the bottles have e.g. on the necks and/or on the closures surfaces plane-parallel to the base of the bottle, with which they lie on holders in the apparatus. The plane-parallel surfaces on the bottle necks can be, in particular, circumferential grooves (constrictions) in the bottle neck which fit exactly into corresponding gripping brackets of the processing apparatus and in this way render possible exact docking of the bundle on to the processing apparatus. The gripping brackets are preferably constructed as semicircular or U-shaped recesses in a continuous plate, the recesses corresponding to the bottle necks and in particular having dimensions such that the bottle necks of the bundle are held with an accurate fit but not too tightly. Advantageously, after docking, for each bottle of the bundle at least 35%, in particular at least 40% of the circumferential depression in the bottle neck (groove) lies on the U-shaped recesses of the gripping bracket. For this purpose plastics are particularly suitable as the material for the bottles, in particular mouldable plastics, such as polyethylene (PE), polypropylene (PP), polyethylene terephthalate (PET) or polyvinyl chloride (PVC); mixtures of the plastics mentioned; or copolymers of the monomers on which the polymers mentioned are based. Rustproof materials, such as plastics, nonferrous metals and high-grade steels, and materials coated with rustproof materials, e.g. steels coated with rustproof materials, are preferred for the brackets. It is also possible to equip the processing apparatus with gripping brackets with recesses which are wide enough to let through the closures of the bottles. In this case the gripping bracket can also serve as the support surface for the bundle carton.

In the variant in particular in which the bottle necks of the bottles have a groove which is inserted into the bracket of the processing apparatus with an accurate fit, it has proved favourable for reliable and rapid handling if a support surface for the bundle is folded out of the apparatus. It is advantageous here if the support surface is arranged horizontally after folding out, so that the bundle can easily be placed on it from the top.

The gripping brackets are preferably connected at right angles and firmly to the support surface which can be folded out and point upwards in the folded-out state. With a suitable arrangement of the bottle necks in the carton, e.g. as described in the following, the bundle can thus be inserted simply into the processing apparatus with an accurate fit and without the risk of mixing up. To simplify handling further, the folded-out horizontal support surface preferably does not fill up the entire area underneath the bundle carton, but in particular has lateral recesses which render it possible to grip underneath the carton.

To avoid mixing up, e.g. between paper or film chemicals, and/or to avoid laterally inverted insertion into the processing apparatus, the bundles according to the invention are preferably equipped with adhesive labels which clearly show the nature of the bundle and the correct insertion position. In addition, however, it is advantageous reliably to rule out mixing up reliably e.g. by length and/or width stops on the bundle holder in the apparatus and/or by at least one asymmetrically positioned groove in the bundle and a corresponding peg on the apparatus. It has proved particularly advantageous to construct the arrangement of the bottle necks asymmetrically, so that laterally inverted insertion is not possible. In addition, in the case of bottles of different size the bottle necks are arranged centrally as is usual, but the neck of a bottle can also itself be asymmetric with respect to the bottle. By a suitable arrangement of the bottles with different volumes and the position of the bottle necks, both mixing up of the chemicals bundles and laterally inverted insertion thereof can be reliably avoided.

The bottle closures are preferably screw closures, which in particular secure a preferably welded seal and leave a passage free in the continuation of the bottle neck, through which the seal can be pierced with means on the apparatus. As stated above, for reliable docking, piercing and emptying it is particularly preferable if the bottles of the bundle have the same height. The bottles are already held by the gripping brackets in the correct position for piercing. To make the operation even more reliable and in particular to arrange the piercing opening exactly over the piercing tool, on the upper edge the closure of the bundle bottles has a narrow ring (centring ring), the internal diameter of which is the same as or somewhat larger that the diameter of the piercing opening. The bottle necks can be positioned exactly therewith by the apparatus when the support surface provided with a bundle according to the invention is folded in. On the apparatus, narrow spacers against which the centring rings stop in the folded-up state of the support surface may be provided for this above the piercing tool for each centring ring.

After the support surface has been folded up, the bundle is preferably arranged vertically and with the bottle necks (the pouring openings) downwards, as a result of which emptying after piercing takes place automatically due to gravity.

Piercing is carried out automatically by the apparatus or manually if required. The tools employed for this are conventionally sharp and are operated with considerable force in order to reliably guarantee the piercing. Exact positioning of the piercing opening is therefore indispensable. p Further preferred embodiments of the invention are to be found in the sub-claims.

EXAMPLES

Example 1

Colour developer concentrates were prepared which were made up to the same replenisher volume of 4.5 litres (L) on mixing. The antioxidant content was adjusted such that in spite of different filling of the bottles, after mixing to a replenisher volume of 4.5 L the same antioxidant content theoretically should result in all the replenishers.

The concentrates were stored for 2 weeks in PE bottles in a heated cabinet at 60° C. In each case 4.5 litres of replenisher, in which the antioxidant content was determined analytically, were mixed from the concentrates in each case in the fresh state and after storage for 1 and 2 weeks.

The developer concentrate 1 used had the following composition:

| | |
|---|---|
| DEHX (antioxidant) | 30 g |
| CD-3 | 70 g |
| Diethylene glycol | 60 ml |
| Polyethylene glycol, Mw 400 | 100 ml |
| Whitener | 10 g |
| EDTA | 30 g |
| Potassium carbonate | 120 g |
| KOH | 50 g |
| make up to 1 liter with water; the pH of approx. 14 results by itself. | |

The developer concentrate 2 used had the following composition:

| | |
|---|---|
| DEHX (antioxidant) | 37.5 g |
| CD-3 | 87.5 g |
| Diethylene glycol | 75 ml |
| Polyethylene glycol, Mw 400 | 125 ml |
| Whitener | 12.5 g |
| EDTA | 37.5 g |
| Potassium carbonate | 150 g |
| KOH | 62.5 g |
| make up to 1 liter with water; the pH of approx. 14 results by itself. | |

The developer concentrate 3 used had the following composition:

| | |
|---|---|
| DEHX (antioxidant) | 50 g |
| CD-3 | 117 g |
| Diethylene glycol | 100 ml |
| Polyethylene glycol, Mw 400 | 167 ml |
| Whitener | 16.7 g |
| EDTA | 50 g |
| Potassium carbonate | 200 g |
| KOH | 83 g |
| make up to 1 liter with water; the pH of approx. 14 results by itself. | |

TABLE 1

| Developer concentrate | Bottle filling | Antioxidant content in the replenisher (g/L) | |
|---|---|---|---|
| 1 | 100% | fresh | 6.5 |
| 1 | 100% | after storage for 1 week | 6.1 |

TABLE 1-continued

| Developer concentrate | Bottle filling | Antioxidant content in the replenisher (g/L) | |
|---|---|---|---|
| 1 | 100% | after storage for 2 weeks | 5.5 |
| 2 | 80% | fresh | 6.6 |
| 2 | 80% | after storage for 1 week | 5.4 |
| 2 | 80% | after storage for 2 weeks | 3.9 |
| 3 | 60% | fresh | 6.6 |
| 3 | 60% | after storage for 1 week | 4.7 |
| 3 | 60% | after storage for 2 weeks | 2.7 |

As can clearly seen from table 1, the antioxidant in the concentrate is degraded faster the less the bottle is filled with a volume of liquid.

Example 2

From the developer concentrates 1–3 prepared and stored under example 1, developer tank fillings were prepared after storage at 60° C. for 2 weeks by adding 1.2 L of 94 CD-LR starter to in each case 6.5 L of replenisher and making the mixture up to 18 litres. The pH of the tank solutions was 10.2. Non-exposed type 11 paper was processed in these tank solutions prepared in this way from developer concentrates 1–3. After processing, the image whites were determined sensitometrically.

TABLE 2

| Developer concentrate | Bottle filling | D min*1,000 after storage of the concentrates | gb | pp | bg |
|---|---|---|---|---|---|
| 1 | 100% | after storage for 2 weeks | 117 | 127 | 124 |
| 2 | 80% | after storage for 2 weeks | 125 | 133 | 126 |
| 3 | 60% | after storage for 2 weeks | 131 | 138 | 127 |

As can be seen from table 2, the image whites after storage of the concentrates are poorer the less the concentrate bottles were filled.

Example 3

The developer concentrate described under example 1 was varied in that different ratios of antioxidant (DEHX) and colour developer (CD-3) were employed. The amount of CD-3 here was in each case kept constant and the amount of antioxidant varied. The bottles were in each case filled full.

A developer tank filling was then in each case prepared by the process described under example 2, in which step wedges exposed with a grey wedge were processed. In each case the fog values and the maximum densities were determined here. The results are shown in table 3.

TABLE 3

| Ratio | Dmin*1,000 | | | Dmax | | | |
|---|---|---|---|---|---|---|---|
| DEHX/CD-3 | gb | pp | bg | gb | pp | bg | |
| 0.3 | 142 | 138 | 128 | 2.19 | 2.29 | 2.52 | comparison |
| 0.7 | 121 | 131 | 125 | 2.18 | 2.38 | 2.52 | invention |
| 2.0 | 118 | 128 | 124 | 2.15 | 2.36 | 2.51 | invention |
| 3.5 | 116 | 126 | 123 | 2.11 | 2.35 | 2.50 | invention |
| 4.5 | 115 | 126 | 123 | 1.67 | 2.24 | 2.47 | comparison |

As can be seen from table 3, the fog is improved by a higher ratio of DEHX/CD-3, and at a ratio of below 0.5 an unacceptable deterioration chiefly of the yellow fog occurs. At a ratio above 4.0, however, a very significant reduction chiefly of the yellow maximum densities occurs, so that optimum image results can be achieved only at the ratios claimed.

The invention claimed is:

1. Bundle for simultaneous refilling of chemicals for processing colour photography silver halide materials in an automatic processing apparatus, wherein the bundle comprises at least one bottle with the refilling solution for a colour developer and at least two bottles with refilling solutions for a bleach-fixing bath, characterized in that the bottle with the refilling solution for the colour developer comprises more than 60 g of colour developer substance per 1 L of bottle volume, the bottle volume for the colour developer refilling solution is about 1 L, the bottle volume for one of the at least two refilling solutions for the bleach-fixing bath is about 2 L and for the other of the at least two refilling solutions for the bleach-fixing bath is about 1 L, and the filling volume in the at least three bottles is in each case at least 90 vol. %, based on the bottle volume.

2. Bundle according to claim 1, characterized in that the three bottles mentioned all have a ratio of the height (H) to the widest base side (S) of the bottles of 1.5:1 to 3:1.

3. Bundle according to claim 1, characterized in that the filling volume in the three bottles mentioned is in each case at least 95 vol. %, based on the bottle volume.

4. Bundle according to claim 1, characterized in that the refilling solution for the colour developer comprises an antioxidant and the molar ratio of antioxidant to developer substance in the refilling solution for the colour developer is 0.5:1 to 4:1.

5. Bundle according to claim 4, characterized in that the antioxidant is bis-sulfoethylhydroxylamine.

6. Bundle according to claim 1, characterized in that the refilling solution for the colour developer comprises water and an organic solvent and the weight ratio of water to organic solvent in the refilling solution is 50:50 to 95:5.

7. Bundle according to claim 1, characterized in that the refilling solution for the colour developer comprises water and a wetting agent.

8. Process for processing a colour photography silver halide material using an automatic processing apparatus, wherein the silver halide material runs through a colour developer solution, a bleach-fixing solution and a stabilizer solution, the colour developer solution is replenished by metering in from at least one colour developer replenisher tank and the bleach-fixing solution is replenished by metering in from at least one bleach-fixing replenisher tank, and the replenisher tanks are refilled via a chemicals bundle, characterized in that the chemicals bundle is a bundle according to claim 1.

9. Processing process according to claim 8, characterized in that the colour developer solution is replenished with less than 60 ml of colour developer replenisher solution per $m^2$ of processed material.

10. Processing process according to claim 9, characterized in that the replenishment rate is less than 55 ml/$m^2$.

11. Processing process according to claim 8, characterized in that at least 80 $m^2$ of material can be processed with the contents of a chemicals bundle.

12. Processing process according to claim 8, characterized in that the bleach-fixing solution is replenished with less than 100 ml of bleach-fixing replenisher solution per $m^2$ of processed material.

13. Processing process according to claim 8, characterized in that the replenisher tank is filled up to a predetermined level of liquid after refilling of the chemicals, characterized in that the colour developer replenisher tank is refilled with water and the bleach-fixing replenisher tank is refilled at least partly with the overflow of the stabilizer solution.

14. Processing process according to claim 8, characterized in that the development time is less than 40 s.

15. Processing process according to claim 8, characterized in that at the same time when replenishment with colour developer replenisher solution is done, water is also metered into the colour developer solution, the metering rate of the amount of water being at least 10% of the metering rate of the colour developer replenisher solution.

16. Bundle according to claim 1, characterized in that the bottles in the bundle have round screw closures and a seal and the bottles are held together by a carton from which the screw closures project at the same height and, after insertion into the apparatus, are held standing on their head at the wide edge of the screw closures or at the carton surface between the screw closures.

17. Bundle according to claim 1, characterized in that the bottle necks of the bottles in the bundle have circumferential depressions which are inserted into gripping brackets of the processing apparatus.

18. The bundle according to claim 1, wherein the bundle comprises one bottle with the refilling solution for a colour developer and two with refilling solutions for a bleach-fixing bath and one bottle for a stabilizer bath.

* * * * *

UNITED STATES PATENT AND TRADEMARK OFFICE

CERTIFICATE OF CORRECTION

PATENT NO. : 7,160,674 B2
APPLICATION NO. : 10/902708
DATED : January 9, 2007
INVENTOR(S) : Ralf Wichmann It is certified that error appears in the above-identified patent and that said Letters Patent is hereby corrected as shown below:

On the title page:

Item (56), References Cited, Foreign Patent Documents, "EP 0840166 5/1998"

should read -- EP 0840168 5/1998 --.

Signed and Sealed this

Twenty-seventh Day of March, 2007

JON W. DUDAS
*Director of the United States Patent and Trademark Office*